US010518787B2

(12) United States Patent
Tscheng et al.

(10) Patent No.: US 10,518,787 B2
(45) Date of Patent: Dec. 31, 2019

(54) RAIL VEHICLE COMPRISING AN ENGINE COMPARTMENT AND AT LEAST ONE DRIVER'S CAB, AND METHOD FOR GENERATING OVERPRESSURE IN THE ENGINE COMPARTMENT

(75) Inventors: Jorgen Tscheng, Zurich (CH); Michael Welter, Bellheim (DE); Karl-Heinz Buchholz, Kassel (DE)

(73) Assignee: Bombardier Transportation GmbH, Berlin (DE)

( * ) Notice: Subject to any disclaimer, the term of this patent is extended or adjusted under 35 U.S.C. 154(b) by 1077 days.

(21) Appl. No.: 13/991,202

(22) PCT Filed: Dec. 6, 2011

(86) PCT No.: PCT/EP2011/071918

§ 371 (c)(1),
(2), (4) Date: Jun. 3, 2013

(87) PCT Pub. No.: WO2012/076524

PCT Pub. Date: Jun. 14, 2012

(65) Prior Publication Data

US 2013/0252527 A1 Sep. 26, 2013

(30) Foreign Application Priority Data

Dec. 8, 2010 (DE) ..... 10 2010 062 660

(51) Int. Cl.
*B61C 17/04* (2006.01)
*B61D 27/00* (2006.01)

(52) U.S. Cl.
CPC ..... *B61C 17/04* (2013.01); *B61D 27/0018* (2013.01)

(58) Field of Classification Search
CPC ..... B61C 17/04; B61C 5/02; B61D 27/0018
USPC ..... 454/84, 107
See application file for complete search history.

(56) References Cited

U.S. PATENT DOCUMENTS 1,813,218 A * 7/1931 Whittaker ..... B61C 17/04 105/26.05
2,638,056 A * 5/1953 Heidmann ..... B60L 3/00 105/49
2,666,497 A * 1/1954 Weber ..... B61C 5/02 105/59

(Continued)

FOREIGN PATENT DOCUMENTS

DE 523925 5/1931
DE 855275 11/1952

(Continued)

*Primary Examiner* — Steven B McAllister
*Assistant Examiner* — Allen R Schult
(74) *Attorney, Agent, or Firm* — The Webb Law Firm

(57) ABSTRACT

In order to optimize the failure safety of electrical and electronic components located in an engine compartment of a rail vehicle, which additionally comprises at least one driver's cab, the rail vehicle is operated with an air conditioning system, which is provided to generate overpressure in the engine compartment and to control the climate of the at least one driver's cab. The air conditioning system includes a first air guidance system to introduce fresh air into the at least one driver's cab and a second air guidance system to transmit at least one part of the fresh air introduced into the at least one driver's cab into the engine compartment.

20 Claims, 1 Drawing Sheet

(56) References Cited

U.S. PATENT DOCUMENTS

| | | | | | |
|---|---|---|---|---|---|
| 2,709,967 | A * | 6/1955 | Dilworth | B61C 5/02 | 105/35 |
| 2,853,153 | A * | 9/1958 | Sexton | B60H 1/00414 | 180/68.3 |
| 3,848,428 | A * | 11/1974 | Rieter, Jr. | B60H 1/00371 | 165/41 |
| 4,043,143 | A * | 8/1977 | Fluder | B60H 1/00371 | 62/243 |
| 4,059,080 | A * | 11/1977 | Rudert | F01P 11/10 | 123/41.33 |
| 4,607,497 | A * | 8/1986 | Ferdows | B60H 1/00371 | 165/249 |
| 4,953,449 | A * | 9/1990 | Jackson | B60H 3/0616 | 454/138 |
| 4,982,583 | A * | 1/1991 | Matsuda | B60H 1/3204 | 62/244 |
| 5,184,474 | A * | 2/1993 | Ferdows | B60H 1/00371 | 62/244 |
| 5,472,378 | A * | 12/1995 | Skoff | B60H 1/00414 | 180/68.1 |
| 5,878,592 | A * | 3/1999 | Borges | B60H 1/3232 | 62/239 |
| 2010/0269530 | A1* | 10/2010 | Ichikawa | B60H 1/00378 | 62/244 |

FOREIGN PATENT DOCUMENTS

| | | | | |
|---|---|---|---|---|
| DE | 3314039 | A1 | 10/1984 | |
| DE | 102006002606 | * | 8/2007 | B61C 17/04 |
| DE | 102006002606 | B3 | 8/2007 | |
| EP | 2127991 | * | 12/2009 | B61C 5/02 |
| EP | 2127991 | A1 | 12/2009 | |
| JP | 10129476 | A | 5/1998 | |

* cited by examiner

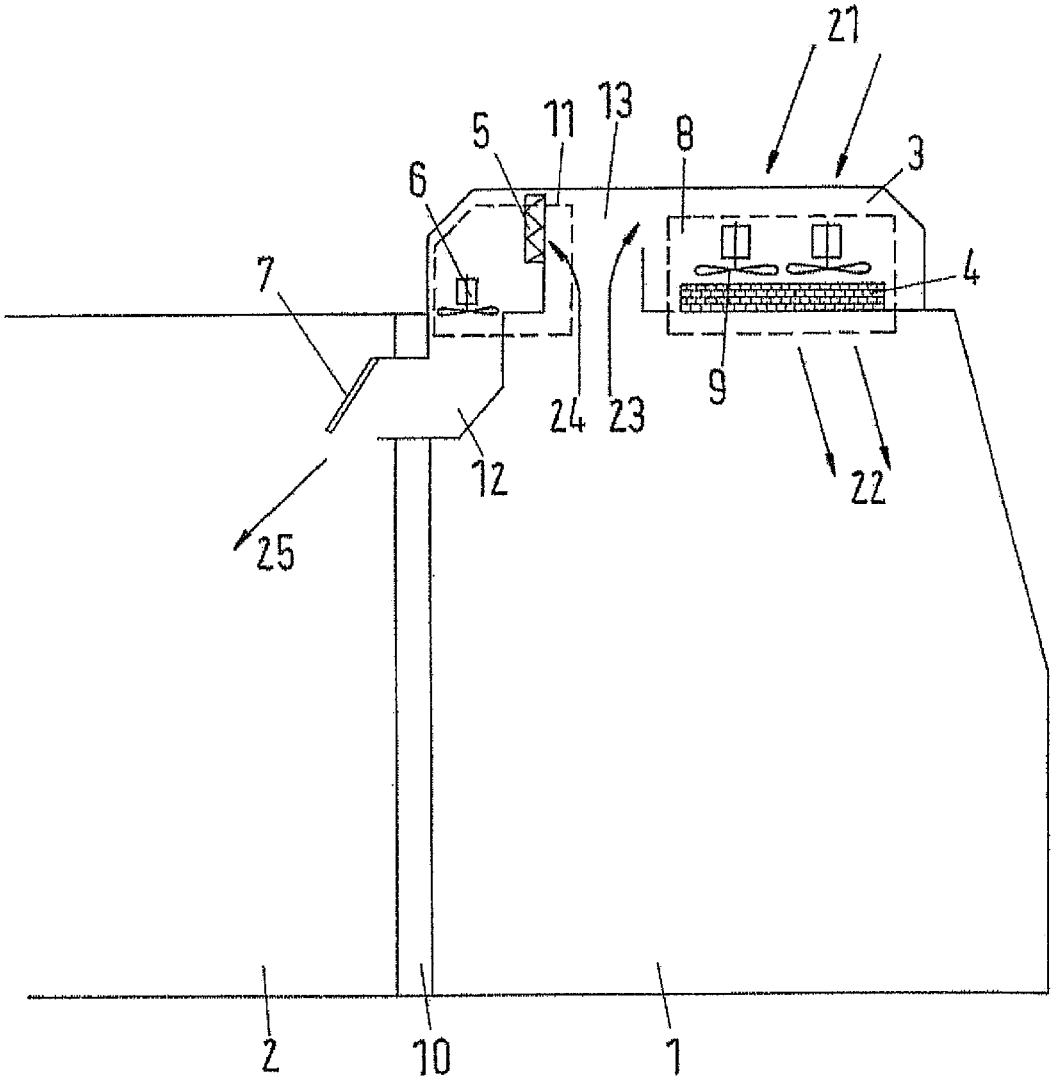
21
13
11
5
8
3
6
4
7
9
24
23
12
22
25
2
10
1

RAIL VEHICLE COMPRISING AN ENGINE COMPARTMENT AND AT LEAST ONE DRIVER'S CAB, AND METHOD FOR GENERATING OVERPRESSURE IN THE ENGINE COMPARTMENT

BACKGROUND OF THE INVENTION

Field of the Invention

The present invention relates to a rail vehicle, for example a traction vehicle, especially a locomotive, a driving unit or a motor coach for a rail vehicle unit train, especially a driving unit for heavy rail vehicle unit trains, for example for long-distance, freight and regional trains wherein the rail vehicle has a system for air conditioning of the at least one driver's cab. Furthermore, the present invention relates to a method for generating an overpressure in the engine compartment in conjunction with an air conditioning system for the at least one driver's cab.

Description of Related Art

The engine compartment of such vehicles accommodates electrical equipment that is necessary in particular for operating the rail vehicle, for example, electrical components intended to supply power for an electrical traction drive, as well as auxiliary systems that do not directly serve to drive the vehicle, for example equipment for generating compressed air. The mentioned electrical and other equipment are sensitive to contamination. For this reason, the engine compartment should be kept as dust free as possible. Otherwise, the service life of this equipment is limited and its failure rate increases.

To achieve this object, a locomotive is described, for example, in EP 2 127 991 A1, having two driver's cabs and one engine compartment wherein at least one refrigerating set and a channel-like conduit system for routing a stream of air cooled by the refrigerating set are provided for cooling the engine compartment and at least one driver's cab. The conduit system allows routing of the cooled air through openings such that the cooled air precisely strikes the components to be cooled or is introduced into the cabinets containing the components to be cooled. In one exemplary embodiment, the locomotive has two driver's cabs that are occupied or unoccupied depending on the direction of travel. In a first embodiment, an air conditioning unit is located in each of the two driver's cabs. The air conditioning unit of the unoccupied driver's cab is intended to cool the engine compartment while, at the same time, the air conditioning unit of the occupied driver's cab is used exclusively to control the climate of this driver's cab. In a second embodiment, there is one central air conditioning unit in the engine compartment. In this case, cooled air is introduced into a conduit system extending in a T shape through the engine compartment into both driver's cabs and routed by way of this conduit system into the occupied driver's cab while the conduit system remains closed at the unoccupied driver's cab so that no cooled air can enter there.

JP 10-129476 A specifies an air conditioning unit for rail vehicles with an internal blower mounted beneath the vehicle floor. The air conditioning unit comprises a first blower for ventilation and for discharging air, two evaporators and a second internal blower. The air drawn in by the first blower is cooled by the first evaporator. The cooled air is mixed with air from inside the vehicle and the resulting mixture is cooled in another evaporator. The cooled air is blown into the interior of the vehicle by the second internal blower.

It is possible to use known air conditioning systems to cool the inside of a vehicle to a sufficiently low temperature. On this topic, EP 2 217 991 A1 specifies that the cooling of electrical and electronic components is necessary to reduce the failure rate of these components. In this case, the cooled air is directed precisely onto the components in the rail vehicle described there. However, it has been found that the failure rate cannot be reduced sufficiently despite this. Furthermore, it must be taken into consideration that the costs for manufacturing a rail vehicle may be high if a plurality of air conditioning units are used like that embodiment specified in EP 2 217 991 A1.

SUMMARY OF THE INVENTION

This and other problems are solved by a rail vehicle according to example embodiments having one engine compartment and at least one driver's cab and a method for generating an overpressure in the engine compartment in conjunction with an air conditioning system of the at least one driver's cab of the rail vehicle according to example embodiments.

The rail vehicle according to the invention has an engine compartment and at least one driver's cab. The rail vehicle may be, for example, a locomotive, a driving unit or a motor coach for a rail vehicle unit train, especially a driving unit for heavy rail vehicle unit trains, for example, for long-distance, freight and regional trains.

The rail vehicle according to the invention comprises an air conditioning system intended to control the climate of at least one driver's cab, this system generating an overpressure in a preferably adjacent engine compartment at the same time. In the type and manner of the invention, the air conditioning system comprises a first air guidance system to introduce fresh air into at least one driver's cab and a second air guidance system to transmit at least part of the fresh air introduced into the at least one driver's cab into the engine compartment.

According to this, the method to generate an overpressure in the engine compartment in conjunction with controlling the climate of the at least one driver's cab of the rail vehicle comprises the introduction of fresh air into the at least one driver's cab and also transmitting at least part of the fresh air introduced into the at least one driver's cab into the engine compartment.

With the invention, the air introduced into the at least one driver's cab by way of the air conditioning system and, if necessary, already filtered and/or cooled is at least partially transmitted into the engine compartment so that the air pressure in the engine compartment is higher than the environment. In this way, the air introduced into the engine compartment contains substantially fewer impurities and/or moisture than fresh air entering the engine compartment directly from outside so that the failure safety of the electrical and other components located in the engine compartment is optimized. This is because each additional entry of fresh air into the engine compartment increases the amount of impurities carried into and/or moisture penetrating the engine compartment. Since introducing a relatively small amount of air via the at least one driver's cab is sufficient for the operation of the engine compartment in the vehicle, the entry of impurities and/or moisture into the engine compartment is minimized. In any case, it is preferred to transmit only as much air from the at least one driver's cab into the engine compartment as necessary for maintaining a slight overpressure so as not to jeopardize the failure safety of the components in the engine compartment. By transmitting the fresh air introduced into the at least one driver's cab into the engine compartment, if applicable, any impurities contained in the fresh air are already retained in the at least one driver's cab so that they precipitate there. Transmitting the fresh air introduced into the at least one driver's cab into the engine compartment furthermore is sufficient to maintain an increased internal air pressure (in particular, a slight overpressure) with respect to the environment in the engine compartment. The increased air pressure ensures that impurities and/or moisture cannot enter the engine compartment from the outside even if the engine compartment is not completely sealed against the environment because the entry of impurities and/or moisture is prevented by the overpressure.

Diverting air from a traction motor fan to generate the overpressure in the engine compartment has shown to be unsatisfactory for optimizing the failure safety of the electrical and other components because additional impurities and moisture would be carried into the engine compartment in this way. Even the installation of separate engine compartment fans that draw in fresh air has proven to be disadvantageous. Permanent engine compartment filtering that reliably retains the dust of all degrees of fineness and moisture is not possible using this method.

At any rate, air is introduced into the at least one driver's cab to supply fresh air to personnel present there. According to the invention, this fresh air is not diverted in an undefined manner but rather transmitted into the engine compartment after being introduced into the driver's cab.

The air conditioning system comprises, for example, at least one cooling element and, as a result, may be capable of cooling the at least one driver's cab. Furthermore, the air conditioning system may also comprise filter elements, guide elements for the air, for example, guide channels, pipes, and the like, switching equipment for blocking air entry via the guide elements and the like. A cooling element can be placed at any technically preferred location in or on the vehicle. A plurality of cooling elements can be placed at different locations in or on the vehicle.

In one preferred embodiment of the invention, the air conditioning system comprises cooling of the fresh air when introducing the fresh air into the at least one driver's cab to generate cooled air. The cooling is achieved by at least one cooling element, for example, one or more evaporators of a refrigeration machine or thermoelectric cooling elements or other cooling elements.

In another preferred embodiment of the invention, the air conditioning system comprises an engine compartment filtering system that filters the air transmitted from the driver's cab into the engine compartment. This filtering system comprises at least one engine compartment filter device. Filter devices that can be used here are known from the domain of the invention and are formed using appropriate mounts holding materials therein, consisting of fleece fabric, for example, or other gas-permeable material. By these means, the air introduced in the at least one engine compartment is free of impurities and/or moisture, at least to a great extent.

In still another preferred embodiment of the invention, the air conditioning system comprises at least one engine compartment air supply device, for example, including at least one engine compartment fan/at least one engine compartment blower, for transmitting the portion of fresh air of the driver's cab air into the engine compartment. Even these types of devices are known in the domain of the invention and are used in air conditioning engineering. By using at least one engine compartment air supply device, the supply of cooled air to the engine compartment can be made dependent on the supply of fresh air into the at least one driver's cab. The air pressure in the at least one driver's cab differs from the air pressure in the engine compartment in that an overpressure is generated in the engine compartment and, at the same time, roughly normal pressure (corresponding to the air pressure outside the rail vehicle) is maintained in the at least one driver's cab. In this way, the at least one driver's cab can be constantly supplied with fresh air while this is avoided for the engine compartment and air pressure, increased with respect to the air pressure prevalent outside the vehicle, is maintained in the engine compartment. In this way, the fresh air cannot enter inside even through leaks in the outer walls of the engine compartment thereby introducing impurities and/or moisture but at most air can exit the engine compartment to the outside through leaks and other openings.

The engine compartment air supply device and the engine compartment filter device can be combined into one engine compartment air handling device. The engine compartment air handling device can be placed on the roof of the rail vehicle, below the vehicle, in the engine compartment of the vehicle or preferably in the area of the partition between the at least one driver's cab and the engine compartment.

In this way, it has been shown in particular that the cleanliness of the air supplied to the engine compartment is primarily a function of the quality of the filtering system. At least one engine compartment filter device can be located either on the suction side or the discharge side of the engine compartment fan(s) or blower(s) or on both the suction side and the discharge side.

In still another preferred embodiment of the invention, the engine compartment is designed to be essentially sealed such that increased air pressure, with respect to the environment, is formed in the engine compartment when transmitting air into the engine compartment. "Essentially" means that leaks are still present in the housing enclosing the engine compartment and these leaks counteract a complete seal from the outside. Otherwise, the walls of the housing do not leak. At least one engine compartment air supply device that can also serve as the pressure generating means for creating an increased air pressure in the engine compartment generates an interior air pressure increased with respect to the ambient air pressure in the area in the engine compartment to be air conditioned.

In still another preferred embodiment of the invention, the air conditioning system furthermore comprises a driver's cab filter system when introducing fresh air into the at least one driver's cab. This filtering system comprises at least one driver's cab filter device. Even this type of filter devices is known in the domain of the invention. A particularly clean and dry air is produced by the additional filtering of the fresh air upon entry into the at least one driver's cab such that the problems of the known air conditioning systems for rail vehicles can be easily solved. The air conditioning system can still comprise one driver's cab air supply facility each to draw fresh air from outside into the at least one driver's cab. The driver's cab air supply facilities each include one driver's cab air supply device, for example, including at least one driver's cab fan/at least one driver's cab blower. These can be located, as seen in the direction of air flow, before, after or even both before and after the driver's cab filter system.

In still another preferred embodiment of the invention, the air conditioning system furthermore comprises at least one closing device that prevents the air transmitted into the engine compartment from flowing back into the at least one driver's cab. This can be a check valve but also any other device suitable for this purpose, for example, a valve that closes automatically or due to an outside trigger signal as soon as air tries to escape from the engine compartment back into the driver's cab. This closing device serves in particular to maintain an adequate overpressure in the engine compartment without an increased flow of air into the engine compartment being constantly necessary. In particular, this closing device serves to maintain the overpressure once achieved even if the overpressure threatens to dissipate because of a malfunction, for example, a failure of at least one of the engine compartment air supply devices.

In still another preferred embodiment of the invention, the air conditioning system furthermore comprises circulation of a first part of the fresh air introduced into the at least one driver's cab and discharge of a second part of the fresh air into the engine compartment. To achieve this, a stream of air formed in the driver's cab splits into the first and second parts with the first part being introduced into the driver's cab again (circulated) and the second part being transmitted into the engine compartment. Appropriate triggering of the fans can ensure that, at any time, only as much air is supplied to the engine compartment as fresh air is fed to the driver's cab to avoid lower pressure in the driver's cab. In this way, the entry of impurities and/or moisture into the at least one driver's cab and thus their entry into the engine compartment is minimized.

In still another preferred embodiment of the invention, the air conditioning system furthermore comprises cooling of the first part of the circulated fresh air. This achieves continuous cooling of the fresh air circulated in the at least one driver's cab. For cooling, in turn, at least one cooling element, for example, one or more evaporators of a refrigeration machine or thermoelectric cooling elements or other cooling elements, can be used.

The cooling of the circulated air mentioned above can also be implemented by the cooling elements specified previously that are intended for cooling the fresh air introduced into the at least one driver's cab.

In still another preferred embodiment of the invention, the air conditioning system also comprises a circulation filtering of the first part of the circulated air. This filtering system comprises at least one circulation filter device. Continuous filtering of the circulated air further reduces its number of impurities and/or its moisture so that the air transmitted into the engine compartment is even cleaner and/or dryer than without this measure. The circulation filtering may be identical to the driver's cab filtering of the fresh air introduced into the at least one driver's cab so that the fresh air and the air that comes from the driver's cab and is circulated are routed through the same driver's cab filter device. As an alternative, however, two different filter devices may also be provided, namely a circulation filter device for filtering the portion of circulated air and a driver's cab filter device for filtering the fresh air being constantly replenished to the driver's cab.

In still another preferred embodiment of the invention, the air conditioning system comprises at least one refrigeration machine in which at least one evaporator is used for cooling the fresh air. Such an evaporator is a cooling element for the air to be cooled. Refrigeration machines are known and typically comprise at least one evaporator, at least one compressor, at least one condenser and at least one expansion valve in at least one circuit for a refrigerant. At least one evaporator serves to absorb heat from the environment into the refrigerant. Among others, the absorbed quantity of heat is dissipated again by the refrigerant in the at least one condenser. In this way, the at least one evaporator serves as a heat sink and thus as the cooling element for cooling the air.

When using a refrigeration machine in the rail vehicle according to the invention, the at least one evaporator is preferably integrated into a driver's cab air handling device to act there as the cooling element for the fresh air to be cooled. At least one cooling element, furthermore preferably at least one fan or blower and furthermore preferably one filter device may be combined into the driver's cab air handling device. Consequently, the at least one refrigeration machine comprises at least one evaporator each for cooling the air with the at least one evaporator preferably being each a component of a driver's cab air handling device of the air conditioning system in which the cooled air is generated.

Preferably, at least one driver's cab air handling device is present, for example, one air handling device for each driver's cab. Air is cooled in the driver's cab air handling devices and then introduced into the appropriate driver's cab.

The evaporator(s) may be installed either before or after, seen in the direction of flow of the air used for air conditioning, the driver's cab filter device mentioned above. If two filter devices are used, namely one driver's cab filter device for filtering the introduced fresh air and one circulation filter device for filtering the circulated and already cooled, if necessary, air from the driver's cab intended for reintroduction into the driver's cab, these two filter devices are installed before the evaporator, seen in the direction of flow of the air. If the evaporator(s) is installed after the driver's cab filter device, particularly clean filtered air can then be routed via the evaporator(s) so that the danger of fouling the evaporator(s) is reduced.

The at least one driver's cab air handling device can be placed in particular within at least one of the driver's cabs. As an alternative, it can also be mounted outside the driver's cabs, in particular outside the rail vehicle, for example, on the roof or—less preferred—beneath the floor of the rail vehicle. A configuration in the driver's cab is, of course, preferred because this is combined with encapsulation against heat and impurities entering from the outside. Furthermore, no additional space within the vehicle profile specified by a railroad operating company need be claimed for this device.

In place of a refrigeration machine comprising evaporator, compressor, condenser and expansion valve, a thermoelectric cooling element or some other cooling element may also be used.

The engine compartment air handling device and the driver's cab air handling device may be combined into one joint air conditioning unit and are a component of the air conditioning system.

BRIEF DESCRIPTION OF THE DRAWING

The present invention will be explained in more detail using the descriptive FIGURE below. In particular, FIG. 1 shows a schematic longitudinal section view of one part of a rail vehicle according to the invention.

DETAILED DESCRIPTION OF THE DISCLOSED EMBODIMENTS

Identical reference numbers refer to elements in the FIGURE having the same function.

FIG. 1 shows a schematic longitudinal section view of the front part of a rail vehicle according to the invention, for example, an electric locomotive. The driver's cab 1 is shown on the right side of the drawing. The engine compartment 2 of the vehicle is located on the left adjacent to and separated from the driver's cab 1 by a partition 10. The partition 10 may also incorporate a door separating the two compartments, this door preferably closing so as to be gas-tight (not shown). For the purpose of more clearly showing the invention, the electrical devices located in the engine compartment 2, for example, electronic facilities with electronic and/or microelectronic devices for controlling vehicle operation, have been omitted from the drawing.

An air conditioning unit 3 is installed in the area of the driver's cab 1 on the roof of the rail vehicle. The air conditioning unit 3 could also be located beneath the floor of the vehicle or, as an alternative—and one that is preferred—within the driver's cab 1.

The air conditioning unit 3 comprises a driver's cab air handling device 8 that, in this case, contains two driver's cab fans 9 and one evaporator 4. In addition, a driver's cab filter device (not shown) is located in the driver's cab air handling device 8 and, seen in the direction of flow of the fresh air being drawn in, after the driver's cab fans 9 and before the evaporator 4. The additional components belonging to the evaporator 4 of a refrigeration machine, the compressor, condenser and expansion valve, can also be accommodated in the air conditioning unit 3 or at some other location in the rail vehicle.

Furthermore, an engine compartment air handling device 11, which combines an engine compartment fan 6 and an engine compartment filter device (circulation filter) 5, is located in the air conditioning unit 3.

Air guidance systems 13 (only shown schematically) for already cooled air flowing out of the driver's cab 1 are located between the driver's cab air handling device 8 and the engine compartment air handling device 11 in the air conditioning unit 3, these guidance systems 13 supplying a first part of the air into the driver's cab air handling device 8 and a second part of the air into the engine compartment air handling device 11.

An air duct 12 serves to transmit the cooled air into the engine compartment 2. Furthermore, a check valve 7 is installed in the partition 10 separating the driver's cab 1 from the engine compartment 2, or in the air duct 12.

Fresh air coming from the outside enters the driver's cab air handling device 8 in a specified minimum quantity by way of the roof of the rail vehicle (first air guidance system, shown by arrow 21). The air is drawn in by way of the driver's cab fan 9 and is then cooled by the evaporator 4. Furthermore, the air is also routed through a driver's cab filter device (not shown) located in the driver's cab air handling device 8 to clean the air. After the air is cleaned and then cooled in evaporator 4 to a specified temperature, the air exits downward out of the driver's cab air handling device 8 and enters the driver's cab 1 (shown by arrows 22).

The cooled air introduced into the driver's cab 1 is drawn in again by the air conditioning unit 3 and is split in the second air guidance system 13. A first part of the air is again drawn into the driver's cab air handling device 8 by the driver's cab fan 9 and cooled there again (represented by arrow 23). This results in a cooling circulation of the air in the driver's cab 1. The cooled air exiting the evaporator 4 downward into the driver's cab 1 thus contains portions of fresh air and portions of circulated air (shown by arrows 22). A second portion of the air, roughly corresponding to the amount of fresh air being supplied continuously, is drawn into the engine compartment air handling device 11 by the engine compartment fan 6 where the air drawn in is first routed through the engine compartment filtering system 5 (represented by arrow 24). The cleaned air then reaches the, to a large degree sealed, engine compartment 2 by way of the air duct 12 and the check valve 7 (shown by arrow 25). Air is continuously introduced into the engine compartment 2 by means of the engine compartment fan 6. This results in an air pressure, increased with respect to the environment, in the engine compartment 2. The air can escape from the engine compartment 2 into the environment at most due to leaks in the housing of engine compartment 2. For this reason, a small air flow into the engine compartment 2 suffices to generate the overpressure. Since this air was already introduced as fresh air into the driver's cab 1, substantially smaller amounts of impurities and moisture are transmitted into the engine compartment 2 than with direct entry of fresh air into the engine compartment 2. Should the engine compartment fan 6 fail, the overpressure in the engine compartment 2 would dissipate quickly by way of the air duct 12. The check valve 7 that closes the opening between the driver's cab 1 and the engine compartment 2 is provided to avoid this. The air entering the engine compartment 2 is particularly clean due to the multiple filtering actions.

The invention claimed is:

1. A rail vehicle including an engine compartment and at least one driver's cab, wherein the rail vehicle comprises an air conditioning system configured to generate an overpressure in the engine compartment and to control a climate of the at least one driver's cab, wherein the air conditioning system comprises a first air guidance system configured to introduce fresh air into the at least one driver's cab and a second air guidance system configured to transmit at least part of the fresh air which has been introduced into the at least one driver's cab from the at least one driver's cab into the engine compartment by drawing the at least part of the fresh air from the at least one driver's cab into the second air guidance system and expelling the at least part of the fresh air into the engine compartment via an air duct extending from the second air guidance system into the engine compartment;

wherein all of the air introduced into the second air guidance system comes directly from the driver's cab;

wherein the second air guidance system defines an opening into the at least one driver's cab for drawing air from the at least one driver's cab back to the first air guidance system;

wherein the overpressure generated by the air conditioning system in the engine compartment by transmitting at least part of the fresh air into the engine compartment increases the air pressure in the engine compartment to a pressure greater than an air pressure of the environment outside the engine compartment; and wherein the overpressure generated in the engine compartment reduces an amount of impurities and/or moisture entering the engine compartment.

2. The rail vehicle according to claim 1, wherein the air conditioning system comprises a cooling system configured to cool the fresh air upon introduction of the fresh air into the at least one driver's cab.

3. The rail vehicle according to claim 1, wherein the air conditioning system comprises an engine compartment filtering system that filters the at least part of the fresh air that is transmitted into the engine compartment.

4. The rail vehicle according to claim 1, wherein the air conditioning system comprises at least one engine compartment supply device configured to transmit the at least part of the fresh air into the engine compartment.

5. The rail vehicle according to claim 1, wherein the engine compartment is configured to be essentially sealed such that increased air pressure, with respect to the environment, is formed in the engine compartment when transmitting the at least part of the fresh air into the engine compartment.

6. The rail vehicle according to claim 1, wherein the air conditioning system comprises a driver's cab filtering system upon introduction of the fresh air into the at least one driver's cab.

7. The rail vehicle according to claim 1, wherein the air conditioning system comprises at least one closing device that prevents the at least part of the fresh air transmitted into the engine compartment from flowing back into the at least one driver's cab.

8. The rail vehicle according to claim 1, wherein the air conditioning system is configured to circulate a first part of the fresh air introduced into the at least one driver's cab and to transmit a second part of the fresh air into the engine compartment.

9. The rail vehicle according to claim 8, wherein the air conditioning system is configured to cool the first part of the circulated fresh air.

10. The rail vehicle according to claim 8, wherein the air conditioning system is configured to filter the first part of the circulated fresh air.

11. The rail vehicle according to claim 1, wherein the air conditioning system comprises at least one evaporator, wherein the at least one evaporator serves to cool the fresh air.

12. A method for generating an overpressure in an engine compartment and for controlling a climate of at least one driver's cab of a rail vehicle, the method comprising: introduction of fresh air into the at least one driver's cab via a first air guidance system; and transmission of at least one part of the fresh air which has been introduced into the at least one driver's cab from the at least one driver's cab into the engine compartment by drawing the at least one part of the fresh air from the at least one driver's cab into a second air guidance system and expelling the at least one part of the fresh air into the engine compartment via an air duct extending from the second air guidance system into the engine compartment;

wherein all of the air introduced into the second air guidance system comes directly from the driver's cab;

wherein the second air guidance system defines an opening into the at least one driver's cab for drawing air from the at least one driver's cab back to the first air guidance system;

wherein the transmission of the at least one part of the fresh air which has been introduced into the at least one driver's cab from the at least one driver's cab into the engine compartment increases the air pressure in the engine compartment to a pressure greater than an air pressure of the environment outside the engine compartment; and wherein the overpressure generated in the engine compartment reduces an amount of impurities and/or moisture entering the engine compartment.

13. The rail vehicle according to claim 1, wherein the second air guidance system comprises at least one of the following: a filtering system, a fan, a check valve, or any combination thereof.

14. The rail vehicle according to claim 1, wherein the air duct extends directly from the second air guidance system into the engine compartment.

15. The method according to claim 12, wherein the air duct extends directly from the second air guidance system into the engine compartment.

16. The rail vehicle according to claim 12, wherein the air guidance system comprises at least one of the following: a filtering system, a fan, a check valve, or any combination thereof.

17. A rail vehicle comprising:

an engine compartment;

at least one driver's cab;

an air conditioning system comprising:

a first air guidance system configured to introduce fresh air into the at least one driver's cab;

a second air guidance system configured to generate an overpressure in the engine compartment by drawing at least part of the fresh air from the at least one driver's cab into the second air guidance system and to expel the at least part of the fresh air into the engine compartment via an air duct extending from the second air guidance system into the engine compartment, such that an air pressure in the engine compartment is greater than an air pressure of the environment outside the engine compartment;

wherein the second air guidance system defines an opening into the at least one driver's cab for drawing air from the at least one driver's cab back to the first air guidance system;

wherein all of the air drawn into the second air guidance system comes directly from the at least one driver's cab; and wherein the overpressure generated in the engine compartment reduces an amount of impurities and/or moisture entering the engine compartment.

18. The rail vehicle according to claim 17, wherein the air conditioning system comprises a cooling system configured to cool the fresh air upon introduction of the fresh air into the at least one driver's cab.

19. The rail vehicle according to claim 17, wherein the air conditioning system comprises an engine compartment filtering system that filters the at least part of the fresh air that is drawn into the second air guidance system.

20. The rail vehicle according to claim 17, wherein the air conditioning system comprises at least one engine compartment supply device configured to transmit the at least part of the fresh air into the engine compartment.

* * * * *